US005310000A

United States Patent [19]

Arterbury et al.

[11] Patent Number: 5,310,000

[45] Date of Patent: May 10, 1994

[54] FOIL WRAPPED BASE PIPE FOR SAND CONTROL

[75] Inventors: Bryant A. Arterbury; Holley M. Cornette, both of Houston, Tex.

[73] Assignee: Halliburton Company, Houston, Tex.

[21] Appl. No.: 952,558

[22] Filed: Sep. 28, 1992

[51] Int. Cl.[5] ..... E21B 43/10

[52] U.S. Cl. ..... 166/296; 166/56; 166/157; 166/205; 166/228; 166/300; 166/376

[58] Field of Search ..... 166/56, 157, 205, 227, 166/228, 233, 296, 300, 376

[56] References Cited

U.S. PATENT DOCUMENTS

| | | | |
|---|---|---|---|
| 2,436,198 | 2/1948 | Cardwell et al. | 166/376 X |
| 3,602,307 | 8/1971 | Price et al. | 166/278 |
| 3,726,343 | 4/1973 | Davis, Jr. | 166/278 |
| 3,913,675 | 10/1975 | Smyrl | 166/278 |
| 4,018,282 | 4/1977 | Graham et al. | 166/296 X |
| 4,018,283 | 4/1977 | Watkins | 166/296 X |
| 4,202,411 | 5/1980 | Sharp et al. | 166/296 X |
| 4,239,084 | 12/1980 | Sharp et al. | 166/296 X |
| 4,635,725 | 1/1987 | Burroughs | 166/278 |
| 4,856,590 | 8/1989 | Caillier | 166/278 |
| 4,860,831 | 8/1989 | Caillier | 166/384 |
| 5,004,049 | 4/1991 | Arterbury | 166/228 |
| 5,088,554 | 2/1992 | Arterbury et al. | 166/228 |
| 5,165,476 | 11/1992 | Jones | 166/227 X |
| 5,190,102 | 3/1993 | Arterbury et al. | 166/228 |

*Primary Examiner*—Ramon S. Britts
*Assistant Examiner*—Roger J. Schoeppel
*Attorney, Agent, or Firm*—Tracy W. Druce; Dennis T. Griggs

[57] ABSTRACT

The flow apertures of a perforated mandrel are temporarily sealed by a foil covering sheet which is made of a sacrificial material, for example, zinc, aluminum and magnesium The sacrificial covering sheet prevents dirty completion fluid from passing through and in and out of the screen as it is run into the hole, thereby protecting the screen from plugging. During the time the screen mandrel is temporarily sealed by the sacrificial foil covering, cleaning fluid is circulated through the work string and is returned through the annulus between the screen and the open well bore for removing filter cake, drilling debris and lost circulation material. After the annulus has been cleaned, the annulus is filled with an acid solution or caustic solution, which dissolves the sacrificial foil and opens the base pipe perforations.

23 Claims, 4 Drawing Sheets

FOIL WRAPPED BASE PIPE FOR SAND CONTROL

FIELD OF THE INVENTION

This invention relates generally to apparatus for completing downhole wells, and in particular to well screens for filtering unconsolidated material out of inflowing well fluid in water, oil, gas and recovery wells.

BACKGROUND OF THE INVENTION

In the course of completing an oil and/or gas well, it is common practice to run a string of protective casing into the well bore and then to run the production tubing inside the casing. At the well site, the casing is perforated across one or more production zones to allow production fluids to enter the casing bore. During production of the formation fluid, formation sand is also swept into the flow path. The formation sand is relatively fine sand that erodes production components in the flow path.

In some completions, however, the well bore is uncased, and an open face is established across the oil or gas bearing zone. Such open bore hole (uncased) arrangements are utilized, for example, in water wells, test wells and horizontal well completions. One or more sand screens are installed in the flow path between the production tubing and the open, uncased well bore face.

After the sand screens are in place, water is pumped through the work string for removing drilling debris, filter cake and lost circulation material from the annulus. Large amounts of filter cake and other debris which is not removed from the bore hole can create potential problems with future water and gas coning effects along the horizontal section After the annulus along the uncased well bore has been cleaned, a packer is customarily set above the sand screen to seal off the annulus in the zone where production fluids flow into the production tubing The annulus around the screen may be packed with a relatively coarse sand or gravel which acts as a filter to reduce the amount of fine formation sand reaching the screen.

A common problem experienced during well completion and sand control operations is fluid loss. It is an inherent problem encountered worldwide, due to the high permeability of sandstone reservoirs which allow easy fluid flow into the formation matrix Many wells which are candidates for sand control produce from marginal reservoirs and have insufficient bottomhole pressures to support a column of fluid in the well bore. Still other wells with high pressure zones require high density completion fluids in order to balance the reservoir pressure during the gravel pack operation. In either case, the positive pressure leads to fluid being lost to the reservoir.

This may cause the following problems: (1) the formation may be damaged by swelling of clay minerals within the formation, (2) formation damage caused by particle invasion into the formation, (3) formation damage caused by dissolution of matrix cementation promoting migration of fines within the formation, (4) flow channel blockage by precipitates caused by ionic interactions between well servicing fluids and formation fluids, (5) interactions between well servicing fluids and formation fluids causing emulsion blocks, water block, or changes in wettability of a producing sand, and (6) flow channel blockage due to viscous fluids creating a barrier in the near well bore region. Moreover, some well completion fluids are expensive, presently costing at over $100 per barrel.

DESCRIPTION OF THE PRIOR ART

During many sand control operations, the standard procedure is to acidize the formation prior to gravel packing, thus increasing the near well bore permeability. Then it is recommended that the acid treatment be followed immediately with a gravel pack treatment until a sandout occurs. After gravel packing, the well bore is frequently in a lost circulation condition. This requires either keeping the hole full, resulting in loss of large volumes of completion fluid to the formation, or unknowingly spotting an inappropriate fluid loss pill. Both options can result in formation damage and excessive completion costs.

A critical operation during the completion phase is pulling the work string and running the production tubing after the lost circulation material has been removed from the annulus along the face of an uncased well bore section. As a result of removing the lost circulation material, great amounts of completion fluid may be lost into the formation. These fluids will cause formation damage, such as the swelling of clays which inhibit the formation from producing oil or gas, known as permeability damage of the producing formation.

Due to the heavy weight load imposed by some bottom hole completion assemblies, the screen may become plugged as it passes over the low side cuttings and rubs against the lost circulation type filter cake. If the screen section is run several thousand feet along a horizontal open hole section or if rotation is required to advance the screen, it is likely that the screen will become plugged as it contacts the exposed formation, the lost circulation plugging materials and drilling debris. The plugging materials and debris will be pressed into the flow apertures of the screen and may plug the base pipe perforations.

One method which has been utilized to reduce the loss of circulation fluid is to install a large O.D. washpipe across the screen, which will decrease the return flow along the inner screen/washpipe annulus. However, if the completion fluids are dirty, the entire screen section may be plugged from the inside out during the running procedure. Moreover, the use of large O.D. washpipe increases the weight of the bottom hole assembly, and reduces the flexibility and the ability of the screen assembly to pass the bend section. Additionally, an increase in the weight of the bottom hole assembly imposed by the heavy, large O.D. washpipe makes it more difficult for the vertical section of the pipe to push the screen assembly through the bend and the horizontal section. Consequently, more powerful running equipment is needed at the wellhead. The foregoing are major problems which are commonly encountered in the completion of horizontal wells.

OBJECTS OF THE INVENTION

A general object of the present invention is to provide an improved sand screen assembly which will temporarily prevent the circulation of dirty completion fluid through the screen as it is run into the well, thereby protecting the screen from plugging.

Another object of the present invention is to reduce the loss of completion fluid into the formation during the pulling of the work string and the running of the production tubing.

Yet another object of the present invention is to maintain good flexibility in the sand screen assembly as it is run into the well.

A related object of the present invention is to eliminate the need to run large O.D. washpipe across the screen for the purpose of decreasing the circulation area in the screen I.D./washpipe O.D. annulus.

Still another object of the present invention is to prevent the plugging and contamination of the sand screen assembly caused by the circulation of dirty completion fluids from the inside of the screen assembly through the screen sections as the screen is being run into the well.

Another object of the present invention is to provide an improved well screen assembly for onetime zone production control.

Another object of the present invention is to provide an improved sand screen assembly and method for cleaning the annulus between the sand screen assembly in an open face well bore which will allow turbulent circulation across the one hole section without plugging the perforated screen mandrel.

A related object of the present invention is to reduce the overall weight of the bottom hole sand screen assembly, thereby increasing the distance the bottom hole assembly can be run through a horizontal well bore.

SUMMARY OF THE INVENTION

The foregoing objects are achieved according to one aspect of the present invention by a well screen assembly in which the flow apertures of a perforated mandrel are sealed by a foil wrap covering which is made of a sacrificial material, for example, zinc, aluminum and magnesium. The foil wrap covering temporarily prevents dirty completion fluid from passing through (in and out of) the screen as it is run into the hole, thereby protecting the screen from plugging. After the downhole screen assembly reaches its final position, cleaning fluid is circulated through the end of work string and is returned through the annulus between the screen and the open well bore for removing filter cake, drilling debris and lost circulation material. After the annulus has been cleaned, the screen mandrel and annulus are filled with an acid solution, for example, of hydrochloric acid (HCL) or hydrofluoric acid (HF), or by a caustic solution, for example of sodium hydroxide (NaOH) or potassium hydroxide (KOH), to dissolve the foil wrap covering and to clean the external surface of the screen. The specific acid or caustic solution to be used will be determined in part by the characteristics of the producing formation. After the foil wrap has been dissolved, well completion operations such as gravel packing can be performed, as desired.

Operational features and advantages of the present invention will be understood by those skilled in the art upon reading the detailed description which follows with reference t the attached drawings.

DETAILED DESCRIPTION OF THE PREFERRED EMBODIMENTS

Figure 1:
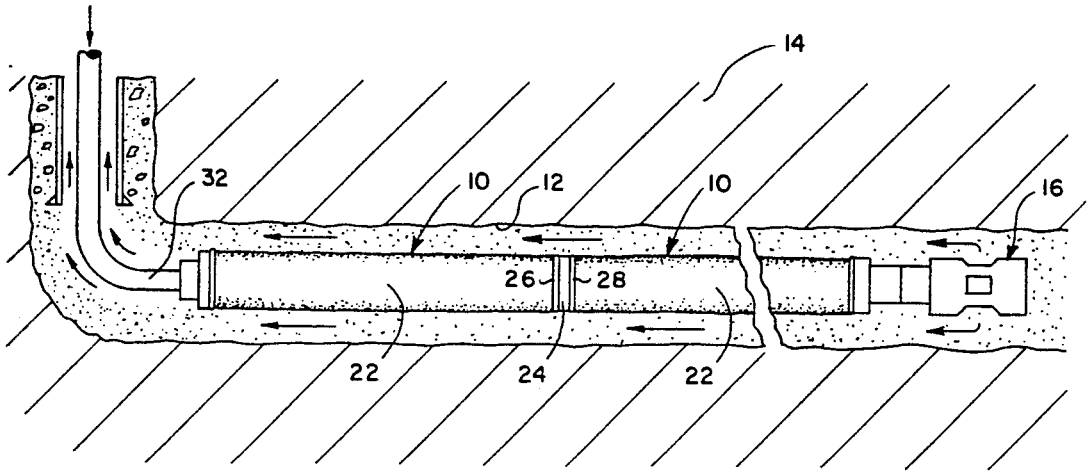
FIG. 1 is a simplified, sectional view which illustrates installation of a sintered metal screen in a horizontal, uncased well bore.

In the description which follows, like parts are indicated throughout the specification and drawings with the same reference numerals, respectively. The drawings are not necessarily to scale and the proportions of certain parts have been exaggerated to better illustrate details of the invention.

Referring now to FIG. 1, a sand screen 10 is shown installed in an uncased horizontal bore 12 which penetrates horizontally through an unconsolidated formation 14. Multiple screen sections 10 are assembled together, with the screen assembly being terminated by a circulation sub 16. This particular screen design may also be used in vertical wells.

Figure 2:
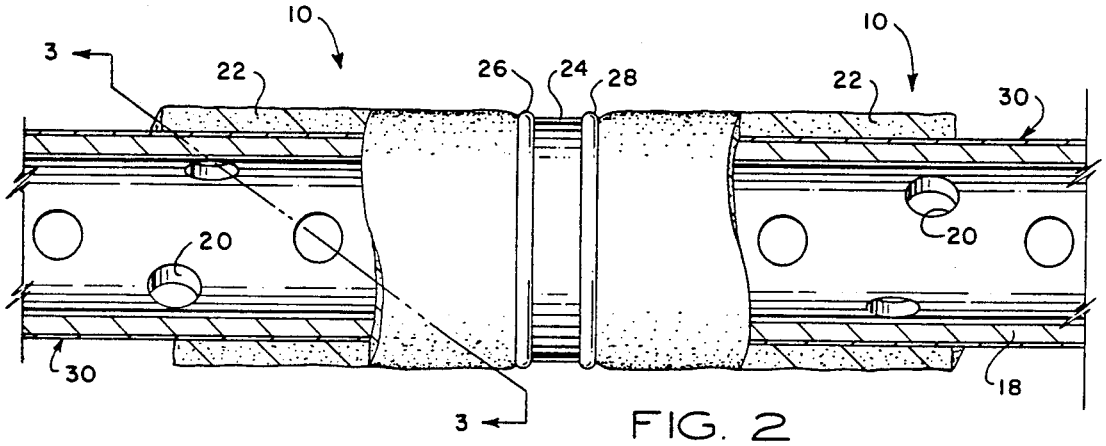
FIG. 2 is a sectional view, partially broken away, of a portion of the sintered metal well screen shown in FIG. 1.
Figure 3:
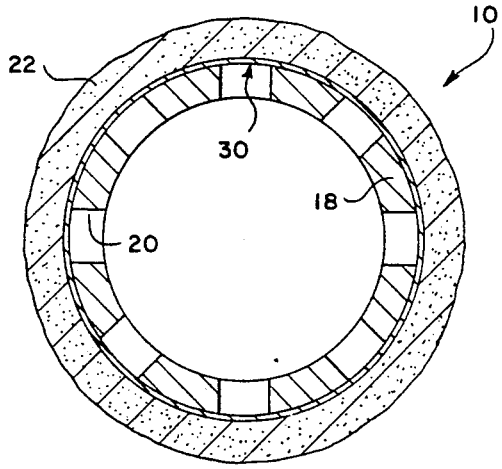
FIG. 3 is a sectional view taken along the line 3—3 of FIG. 2.

Referring now to FIG. 2 and FIG. 3, each screen section 10 includes a tubular mandrel 18 which is perforated by radial flow apertures 20. The mandrel 18 is concentrically disposed within a unitary, porous sleeve 22 of sintered powdered metal. The sintered powdered metal preferably is a corrosion resistant metal such as stainless steel or nickel or nickel chromium alloys such as are sold under the trademarks MONEL and INCONEL. In this embodiment, the sintered metal sleeve 22 provides a screen matrix having a pore size of about 100–150 microns, corresponding to 40–60 mesh. Preferably, the sintered metal sleeve 22 is constructed as disclosed in U.S. Pat. No. 5,088,554 entitled "Sintered Metal Sand Screen", assigned to Otis Engineering Corporation of Carrollton, Tex., and which is incorporated herein by reference for all purposes.

The sintered metal sleeve 22 is a fluid-porous, particulate-restricting member in the form of a tubular sintered metal sleeve having a length in the range of from about 36 inches to about 42 inches. The tubular sleeve 22 is preferably composed of slivers of metal, for example, stainless steel having a length in the range of from about 50 microns to about 1,400 microns. The stainless steel slivers are compressed and then sintered in an oven to yield a porous body having an average pore size in the range of from about 0.001 inch to about 0.006 inch.

The tubular mandrel 18 is perforated by radial flow passages 20 which follow spiral paths along the length of the mandrel 18. The radial bore flow passages 20 permit fluid flow through the mandrel to the extent permitted by the external sintered metal sand screen sleeve 22. The radial bore apertures 20 may be arranged in any desirable pattern and may vary in number, for example, 30 holes per linear foot or 54 holes per linear foot, in accordance with the area needed to accommodate the expected formation fluid flow through the production tubing 46. Adjacent screen sections are coupled together on the mandrel 18 by an annular spacing ring 24 and by resilient, annular seal rings 26, 28. The annular spacer ring 24 is preferably constructed of a corrosion resistant, stainless steel alloy, and the annular seal rings 26, 28 are preferably constructed of a resilient, elastomeric material having properties compatible with the expected downhole pressure, temperature and corrosive environment conditions.

Figure 4:
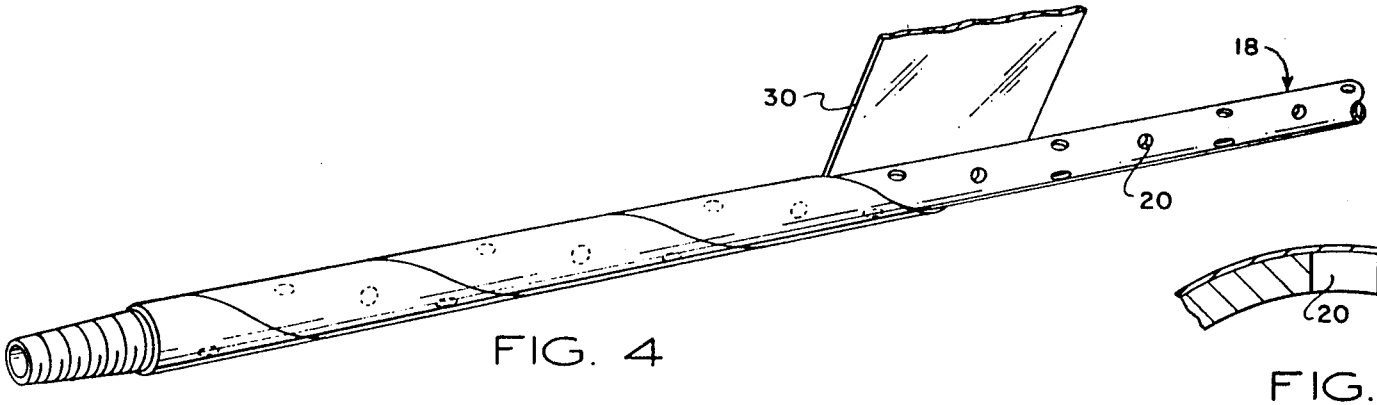
FIG. 4 is a perspective view of a perforated base pipe having a spiral wrapped foil covering.
Figure 5:
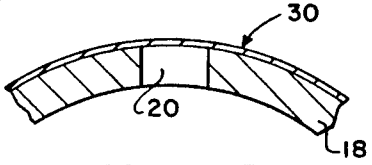
FIG. 5 is a partial sectional view thereof.
Figure 6:
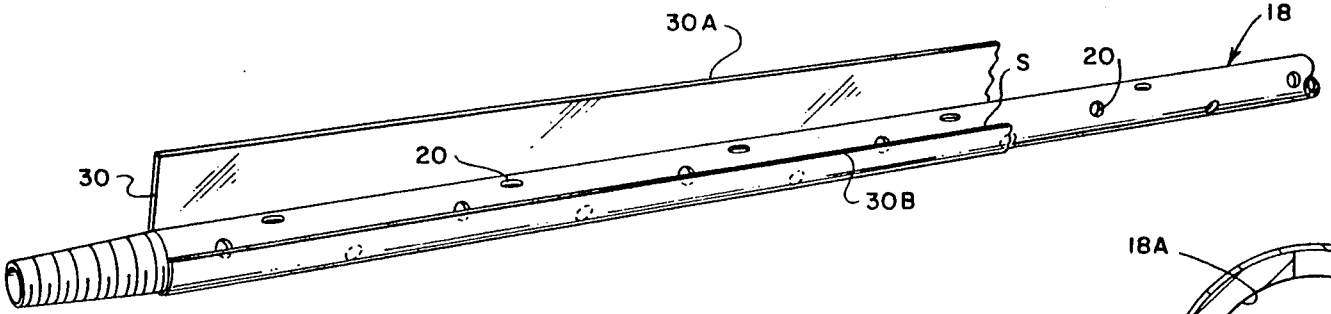
FIG. 6 is a perspective view, partially broken away and partially in section, showing a perforated base pipe having a longitudinal wrap foil covering.
Figure 7:
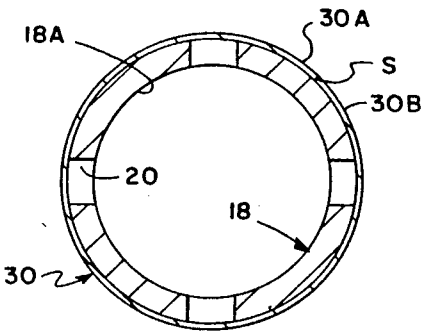
FIG. 7 is a sectional view thereof.

According to this embodiment, the flow apertures 20 are temporarily sealed by a foil covering 30. As shown in FIG. 4, the foil covering 30 is wrapped in a spiral pattern around the perforated mandrel 18. Alternatively, the foil covering 30 may be wrapped circumferentially around the perforated mandrel 18 with its side edges 30A, 30B extending along a straight seam S as shown in FIG. 6 and FIG. 7. Preferably, a thin film of adhesive is spotted onto the external surface of the perforated mandrel 18, thereby providing smooth, tight adhesion of the foil covering 30 along the length of the perforated mandrel. According to this arrangement, the flow apertures 20 are temporarily sealed, thereby cutting off radial flow into the bore 18A of the perforated mandrel.

The perforated mandrel 18 has threaded pin and box connections formed on opposite ends for attachment to the lower production tubing string 32 and for attachment to the circulation sub 16. The perforated mandrel 18 has an appropriate length for accommodating the sintered metal screen sections 10, for example, a longitudinal length of about 20 feet will accommodate four sintered metal screen sections 10 each having a length of about 42 inches, and including standard pin and box fittings. The sintered metal sleeves 22 are assembled onto a length of perforated screen mandrel 18, with the spacer rings 24 and annular O-ring seals 26, 28 being inserted between adjacent screen sections. In this assembly, the sintered metal sleeves 22 are slipped onto the foil wrapped, perforated mandrel 18 along with an appropriate number of annular seal rings and spacers. Longitudinal compression loading of the assembled sintered metal screen sections is achieved with a torque tool and a tubular extension tool.

A predetermined level of compression loading is induced by turning the torque tool until a slight bulge is obtained in the seal rings 26, 28. The loading is then relieved by turning the torque tool in the opposite direction until the bulging disappears. After the desired level of compression loading has been established, an end collar is spot welded onto the mandrel. The sintered metal sleeves are compressed against an end collar which has been spot welded onto the opposite end of the perforated mandrel. According to this arrangement, the mechanical union between adjacent sintered metal screen sections is yieldable to accommodate bending stresses without breaking, for example, during transportation or rough handling in connection with run-in operations, for example, in a highly deviated or horizontal completion. In this assembly, longitudinal compression loading is utilized to stabilize the multiple sintered metal screen sections about the perforated mandrel 18, and the temporary foil covering 30 is captured between the sintered metal sleeves and the perforated mandrel.

Because the flow apertures 20 are sealed by the foil wrapping 30, the foil wrapping temporarily prevents the circulation of dirty completion fluid through the screen as it is run into the well, thereby preventing plugging of the base pipe apertures 20. Moreover, the loss of completion fluid carried in the work string and in the well screen assembly when the circulation sub 16 is closed is substantially reduced during the pulling of the work string and in running of the production tubing, since the base pipe flow apertures 20 are sealed by the foil wrapping 30. The sealing effect of the foil wrapping 30 makes it unnecessary to run large O.D. washpipe across the screen for completion fluid loss control purposes, thereby maintaining good flexibility in the sand screen assembly. Moreover, since the base pipe flow apertures are sealed by the foil wrapping 30, the annulus between the sand screen and the open face of the well bore can be cleaned by turbulent circulation, without risk of plugging the perforated screen mandrel.

After the annulus between the screen and the uncased well bore has been cleared, the radial flow apertures 20 are opened by flooding the bore 18A of the screen mandrel 18 with an acid solution, for example, HCL or HF, or with a caustic solution, for example, NaOH or KOH, so that the foil covering 30 is dissolved. In that arrangement, the foil covering 30 is constructed of a metal which dissolves readily when contacted by an acid solution or caustic solution, for example, zinc, aluminum and magnesium. Zinc is the preferred metal since it exhibits the fastest dissolving rate.

Figure 8:
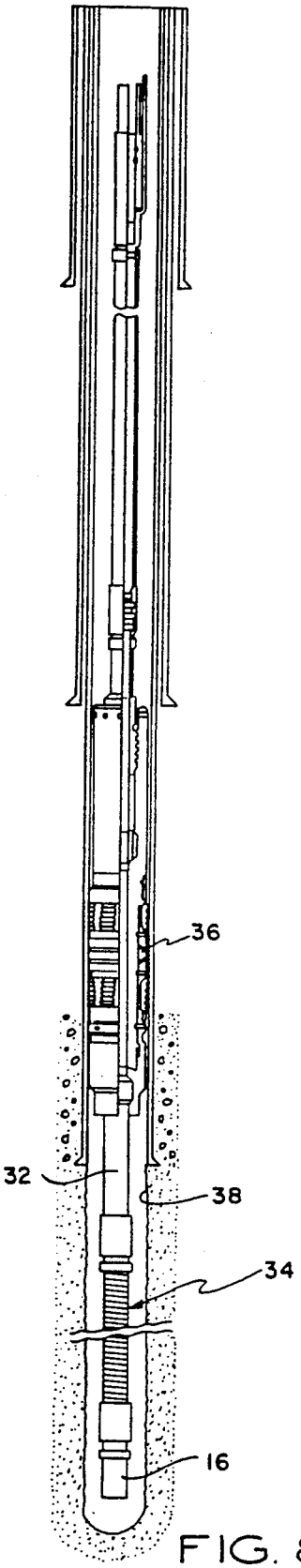
FIG. 8 is a longitudinal view, partially in section, of a wire wrap screen assembly in an uncased, vertical well bore.
Figure 9:
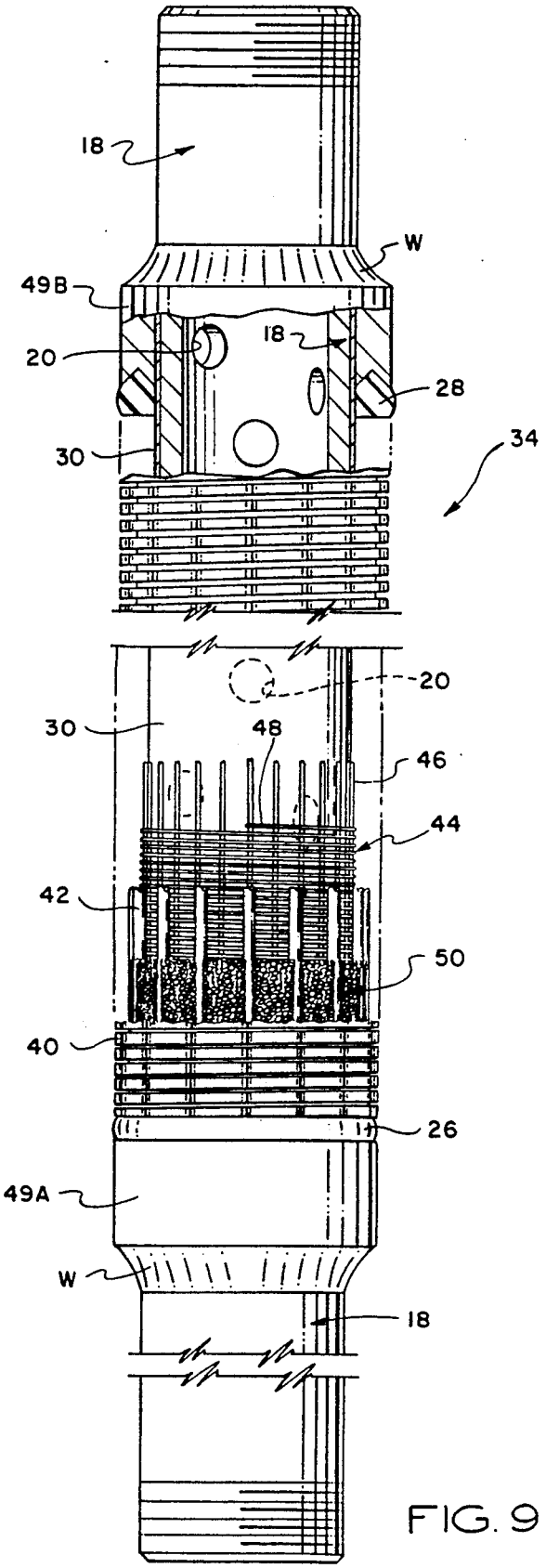
FIG. 9 is an elevational view, partially broken away and partially in section, showing a wire wrapped sand screen which is assembled on a perforated mandrel which has been sealed according to the teachings of the present invention.

Referring now to FIGS. 8 and 9, an alternative sand screen embodiment 34 is illustrated. In this embodiment, a wire wrapped screen 34 is suspended from a production packer 36 in a vertical completion within an uncased well bore 38. The wire wrapped screen 34 includes an external screen wire 40 which is wrapped about longitudinally extending, circumferentially spaced rib wires 42. The rib wires 42 are radially spaced with respect to an inner screen 44 formed by longitudinal rib wires 46 and a small diameter wire wrap 48. The wire wrapped screen 34 is concentrically mounted in radially spaced relation about the perforated mandrel 18 between end collars 49A, 49B. The end collars are secured to the mandrel by welds W. A foil wrapping 30 is confined in the annulus between the perforated mandrel 18 and the screen 34.

In this arrangement, the flow apertures 20 are temporarily sealed by the foil wrapping 30. The foil wrapping may be applied in a spiral pattern as shown in FIG. 4, or in a straight wrapping as shown in FIG. 6, as desired. After the uncased bore annulus has been cleared as discussed above, the bore of the screen mandrel 18 is flooded with an acid or caustic solution, which causes the sacrificial foil wrapping 30 to dissolve.

The annulus between the inner screen and the outer screen is filled by a deposit of prepacked gravel 50. The prepacked gravel deposit 50 includes gravel particles which are generally spherical in shape to provide high permeability. The gravel particles can be coarse sand, solid polymeric granules, composite particles having a metal core surrounded by a corrosion resistant metal coating, and the like, which are sized appropriately to permit passage of formation fluid through the consolidated gravel particles while substantially preventing flow of sand and other consolidated formation materials.

Figure 10:
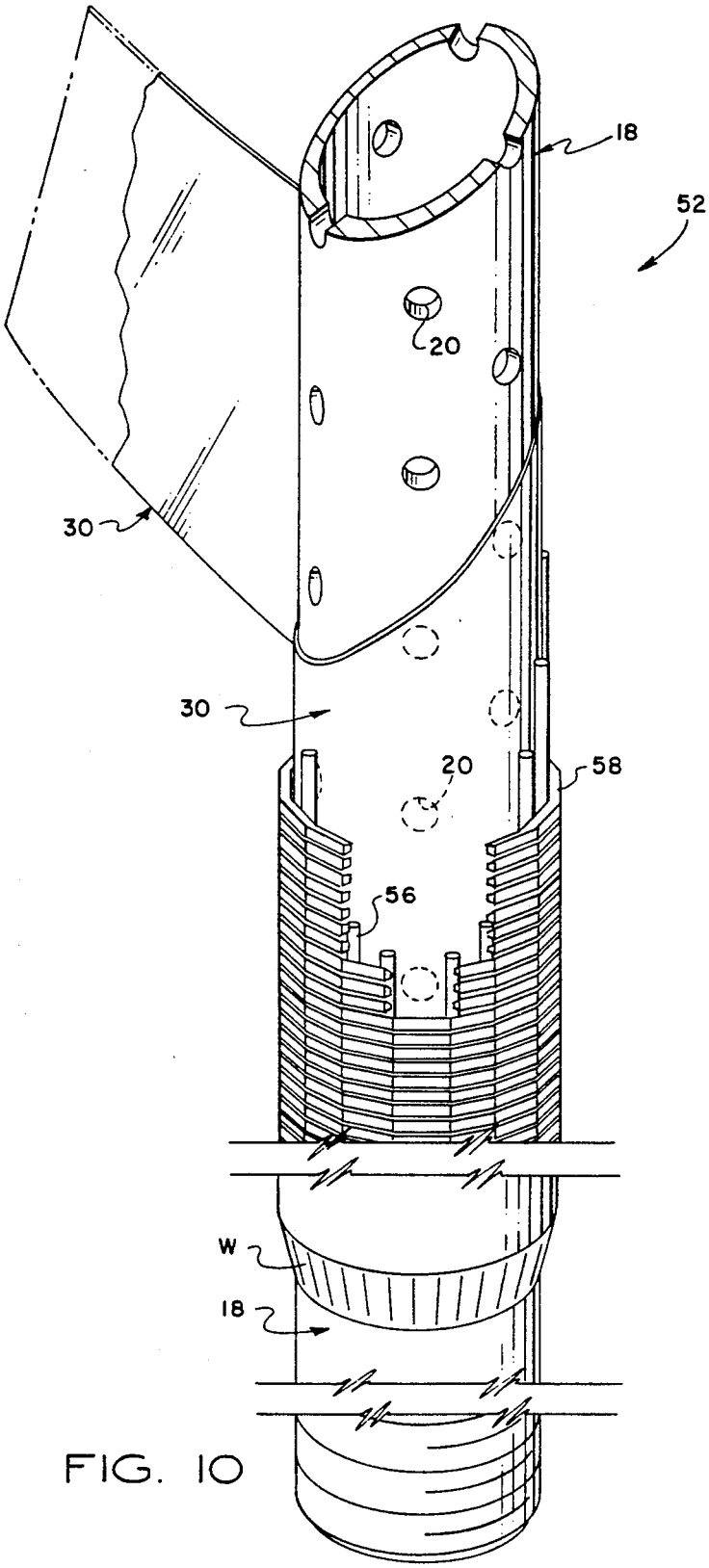
FIG. 10 is a perspective view, partially broken away and partially in section, showing a wire wrapped sand screen assembled on a perforated mandrel which has been sealed according to the teachings of the present invention; and, FIG. 11 is a sectional view, partially broken away, showing a portion of the wire wrapped sand screen of FIG. 10.
Figure 11:
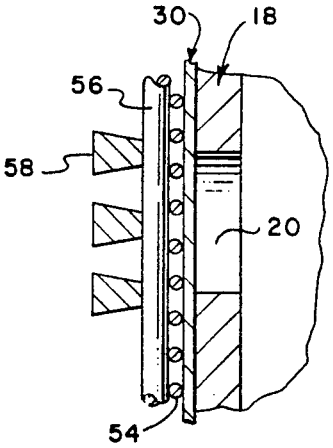

Referring now to FIGS. 10 and 11, an alternative wire wrapped screen 52 has a base pipe mandrel 18 which is temporarily sealed by a foil covering 30. The screen 52 includes a small diameter inner screen wire 54 wrapped about the base pipe mandrel 18, and circumferentially spaced, longitudinally extending rib wires 56 thereby defining longitudinally spaced inner screen apertures for conducting formation fluid through the inner screen, and a large screen wire 58 having a keystone cross section wrapped externally about the rib wires in a longitudinally spaced pattern, thereby defining relatively larger longitudinally spaced screen apertures for conducting formation fluids. The covering 30 is a sheet having a gauge thickness of from about 0.003 inch to about 0.005 inch (3–5 mils) aluminum foil which is applied in a spiral wrap.

The wire wrapped screen 52 must be capable of withstanding rough, run-in handling as well as extreme downhole well production conditions, such as an operating temperature in the range of from about 50 degrees C. to about 300 degrees C., a wide range of formation fluid pH of from about 2 to about 12, high formation pressure up to about 2,000 psi, and contact with corrosive formation fluids containing sulfurous compounds such as hydrogen sulfide or sulfur dioxide.

The sand fines which may be produced following completion may have a fairly small grain diameter, for example, 20–40 mesh sand. Accordingly, the spacing dimension between adjacent turns of the wire wrapped screen 52 is selected to exclude sand fines which exceed 20 mesh.

The primary application of the foregoing screen embodiments 10, 34 and 52 is in an open hole, unconsolidated formation where no gravel pack will be pumped. The formation is simply allowed to slough in and gravel pack itself. This is most desirable in situations where it is questionable whether the unconsolidated formation will allow a liner to be successfully set and when intermixing of the formation sand and gravel pack is probable if a gravel pack is attempted. This condition is most prevalent in highly deviated and horizontal well bores.

As used herein, the term "sacrificial" refers to the property of a material as being subject to being dissolved when contacted by a high pH acid or a low pH base (caustic) solution. It is desirable that the metal selected for the foil covering 30 be characterized by a relatively faster rate of etching or dissolution when contacted by an acid or base solution, as compared to the rate that the base pipe mandrel 18 is affected. The preferred sacrificial materials are aluminum, zinc and magnesium.

During initial assembly, each flow aperture 20 is covered and sealed by the foil 30. The gauge thickness of the foil is selected, for example, 3–5 mils, so that it will be completely dissolved within a predetermined period of exposure to a corrosive acid or base solution, for example, four hours. As the foil dissolves, the flow apertures 20 are opened to permit the flow of formation fluid into the screen.

It will be appreciated that the use of the temporary foil covering will enhance running procedures and bore hole cleaning techniques. The foil covering temporarily eliminates any dirty completion fluid from passing through the primary screen sections as it is run into the hole. The elimination of dirty completion fluids passing in and out of the screen as it is run into the well protects the screen from plugging.

The use of the sacrificial foil wrapping also eliminates the need to run large O.D. washpipe across the screen in order to decrease the circulation area in the screen I.D./washpipe O.D. annulus. This enhances the circulation cleaning effect between the open hole and the screen O.D. while filter cake and lost circulation material are being removed. Large amounts of filter cake and drilling debris which are not removed from the bore hole may reduce production.

Because the flow apertures 20 of the screen mandrel 18 are temporarily sealed by the foil wrapping 30, a substantially smaller diameter washpipe can be used, and in some cases no washpipe is required at all. In the arrangement shown in FIG. 1, water is pumped down the work string through the well screens for circulating through the well bore annulus, thus removing the filter cake residue and drilling debris. By using a smaller washpipe or no washpipe at all, the tubing string becomes more flexible and will allow the screen assembly to pass the bend section more easily as compared with a larger and heavier inner washpipe configuration which tends to be more rigid. The reduction in weight of the sand screen assembly also permits the weight of the tubing string in the vertical section to push the sand screen assembly through the bend into the horizontal section.

Another advantage of the temporary foil covering is the prevention of loss of large volumes of completion fluid into the formation. The foil covering serves as a temporary lost circulation plugging system and reduces the amount of completion fluid loss. Additionally, by using the temporary foil coverings, the screen mandrel bore and work screen can be filled with clean completion fluid as the screen assembly is run into the well bore. This prevents plugging and clogging of the screen from the inside out during the running procedure.

Another advantage is that for an initial, onetime zonal production control, selected areas along the horizontal section can be isolated and produced by selectively dissolving the foil covering in each screen section.

The use of the temporary foil covering also permits the annulus along the open face well bore to be cleaned using turbulent circulation techniques without risk of plugging the screen. Moreover, the temporary foil covering serves as a mechanical fluid loss barrier as the work string and production tubing are moved in and out of the hole.

Various modifications of the disclosed exemplary embodiments as well as alternative well completion applications of the invention will be suggested to persons skilled in the art by the foregoing specification and illustrations. It is therefore contemplated that the appended claims will cover any such modifications or embodiments that fall within the true scope of the invention.

What is claimed is:

1. A well screen for separating particulated material from formation fluid comprising, in combination:

an elongated, tubular mandrel having a longitudinal bore defining a production flow passage, said mandrel being radially intersected by a flow aperture;

a fluid-porous, particulate-restricting member mounted on said mandrel and overlying said flow aperture; and, a sacrificial foil disposed intermediate said particulate-restricting member and said mandrel, said foil covering said flow aperture.

2. A well screen as defined in claim 1, wherein said foil comprises zinc.

3. A well screen as defined in claim 1, wherein said foil comprises aluminum.

4. A well screen as defined in claim 1, wherein said foil comprises magnesium.

5. A well screen as defined in claim 1, wherein said foil comprises a thin metal sheet wound in a spiral pattern about the external surface of said mandrel.

6. A well screen as defined in claim 1, wherein said foil comprises a thin metal sheet wrapped circumferentially about the external surface of said mandrel, said thin metal sheet having side edge portions extending along a straight seam.

7. A well screen as defined in claim 1, wherein said fluid-porous, particulate-restricting member comprises a permeable sleeve of sintered powdered metal.

8. A well screen as defined in claim 1, wherein said fluid-porous, particulate-restricting member comprises circumferentially spaced, longitudinally extending rib wires and a screen wire wrapped externally about said rib wires in a longitudinally spaced pattern, thereby defining longitudinally spaced screen apertures for conducting formation fluids through said outer screen.

9. A well screen for separating particulated material from formation fluid comprising, in combination:

an elongated, tubular mandrel having a longitudinal bore defining a production flow passage said mandrel being radially intersected by longitudinally spaced flow apertures;

a fluid-porous, particulate-restricting member mounted on said mandrel and radially spaced from said flow apertures; and, a sacrificial foil radially confined between the external surface of said mandrel and said fluid-porous, particulate-restricting member, said sacrificial foil sealing said apertures.

10. A well screen as defined in claim 9, wherein said foil comprises zinc.

11. A well screen as defined in claim 9, wherein said foil comprises aluminum.

12. A well screen as defined in claim 9, wherein said foil comprises magnesium.

13. A well screen as defined in claim 9, wherein said foil comprises a thin sheet of metal wrapped about the external surface of said mandrel in a spiral pattern.

14. A well screen as defined in claim 9, wherein said foil comprises a thin metal sheet wrapped circumferentially about the external surface of said mandrel, said thin metal sheet having side edge portions extending along a straight seam.

15. A well screen as defined in claim 9, wherein said fluid-porous, particulate-restricting member comprises circumferentially spaced, longitudinally extending rib wires and a screen wire wrapped externally about said rib wires in a longitudinally spaced pattern, thereby defining longitudinally spaced screen apertures for conducting formation fluids through said outer screen.

16. A well screen for placement within a well bore comprising, in combination:

an elongated mandrel having a tubular sidewall intersected by longitudinally spaced flow apertures formed radially therethrough;

a fluid-porous, particulate-restricting member mounted on said mandrel; and, a sacrificial foil covering said flow apertures, said foil having a body portion which dissolves in response to contact by an acid solution or caustic solution.

17. A well screen as defined in claim 16, wherein said body portion comprises zinc.

18. A well screen as defined in claim 16, wherein said body portion comprises aluminum.

19. A well screen as defined in claim 16, wherein said body portion comprises magnesium.

20. A well screen as defined in claim 16, wherein said body portion is a sheet of metal having a gauge thickness in the range of from about 0.003 inch to about 0.005 inch.

21. In the completion of a well wherein a well screen having a perforated mandrel is run through a well bore, the improvement comprising the steps:

sealing the perforated mandrel with a fluid impermeable sheet disposed intermediate the perforated mandrel and the screen;

pumping cleaning fluid through the annulus between the screen and the well bore for removing debris from the annulus; and, after the annulus has been cleaned, removing portions of said sheet which overlie the mandrel perforations.

22. An improved well completion method as defined in claim 21, in which said covering sheet is made of a sacrificial material, and the removing step is performed by conducting an acid solution or caustic solution in contact with the covering sheet.

23. In the completion of a well wherein a well screen having a perforated mandrel is run through a well bore, the improvement comprising the step:

sealing the performated mandrel with a sacrificial foil disposed intermediate the perforated mandrel and the screen.

* * * * *